United States Patent [19]

Adler

[11] 4,329,106

[45] May 11, 1982

[54] HOPPER CAR DISCHARGE GATE OPERATING MECHANISM

[76] Inventor: Franklin P. Adler, 105 Boyd Cir., Michigan City, Ind. 46360

[21] Appl. No.: 67,629

[22] Filed: Aug. 20, 1979

Related U.S. Application Data

[63] Continuation of Ser. No. 871,640, Jan. 23, 1978, abandoned.

[51] Int. Cl.[3] ..... B65G 67/00

[52] U.S. Cl. ..... 414/388; 105/241.2

[58] Field of Search ..... 414/387, 388; 105/240, 105/241 C

[56] References Cited

U.S. PATENT DOCUMENTS

| | | | |
|---|---|---|---|
| 2,268,290 | 12/1941 | Landis | 105/240 |
| 3,540,605 | 11/1970 | Nagy | 414/388 |
| 3,872,796 | 3/1975 | Adler | 105/241 C |
| 4,051,960 | 10/1977 | Raksanyi | 105/241 C |

FOREIGN PATENT DOCUMENTS

| | | | |
|---|---|---|---|
| 591653 | 1/1960 | Canada | 105/241 C |
| 583013 | 12/1977 | U.S.S.R. | 105/241 C |

*Primary Examiner*—Lawrence J. Oresky
*Attorney, Agent, or Firm*—James J. Conlon

[57] ABSTRACT

A hopper car discharge gate operating mechanism providing a toggle or over center linkage mechanism with one link having a roller extending outwardly of the hopper vehicle and engageable with a trackside operating cam for opening and closing the hopper gates. The roller is mounted on a support arm that is carried by a mechanism link and held with a locking pin in such a manner to allow the locking pin to break and release the arm in the event the doors are jammed closed. The operating mechanism also includes a biasing spring for automatically returning the doors to a closed position after the hoppers are emptied.

8 Claims, 8 Drawing Figures

FIG. 1
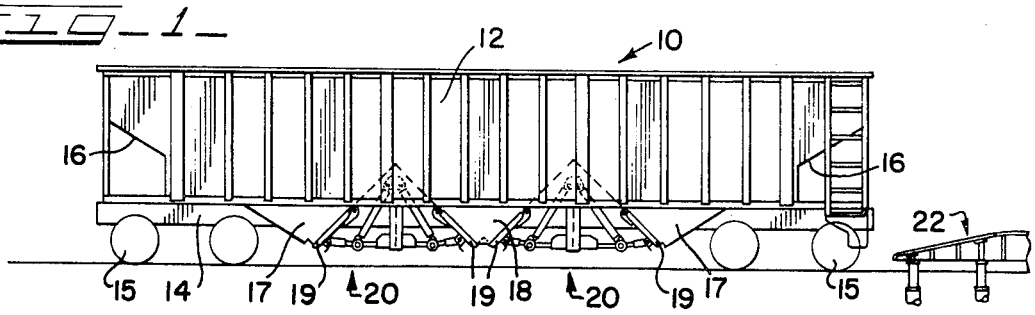
FIG. 2
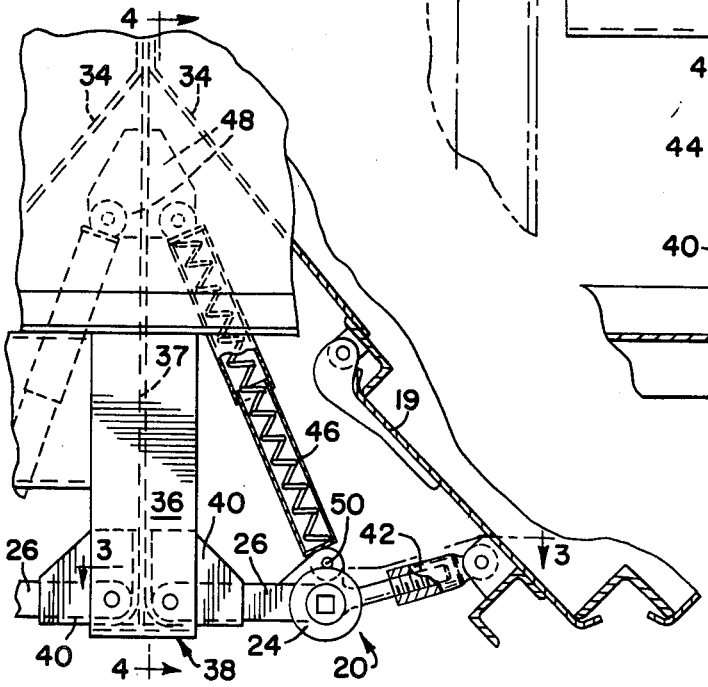
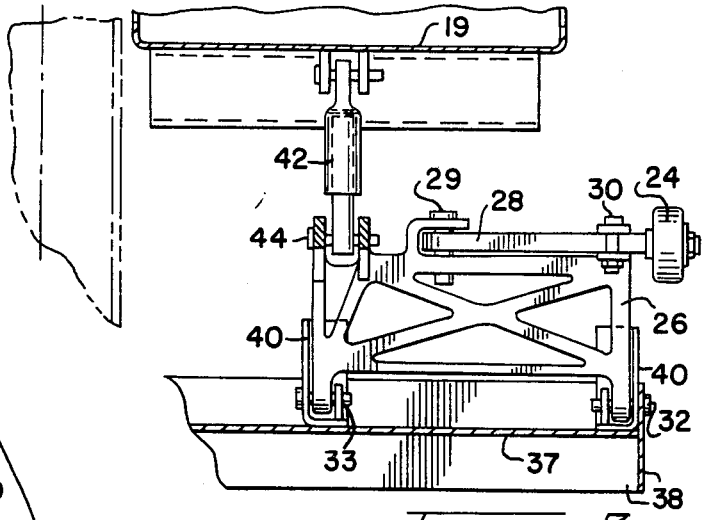
FIG. 3
FIG. 5
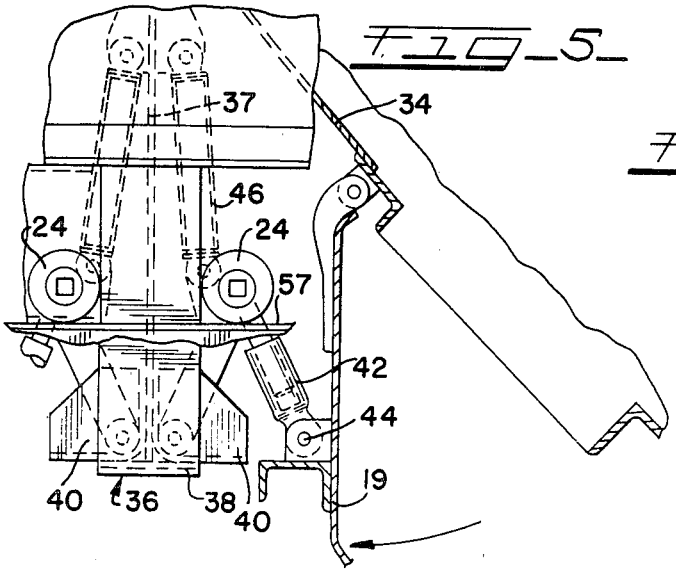
FIG. 7
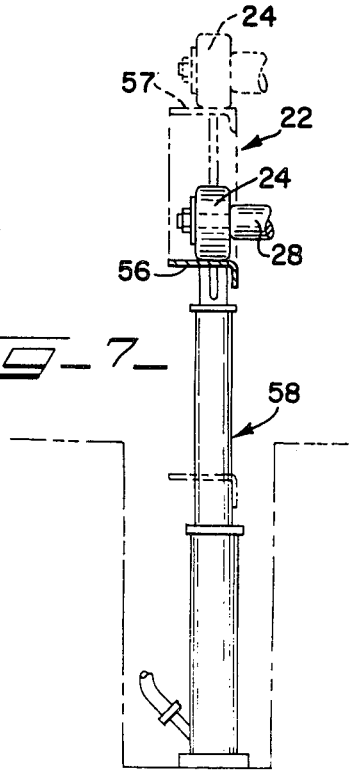

FIG. 6
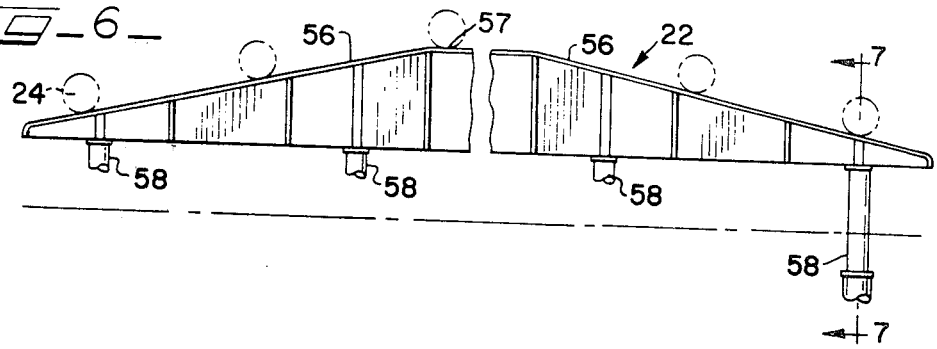
FIG. 4
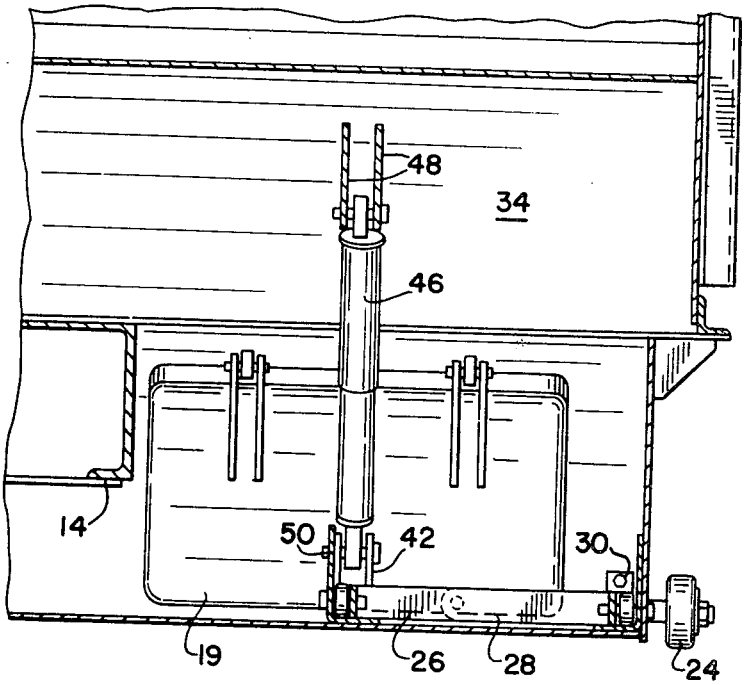
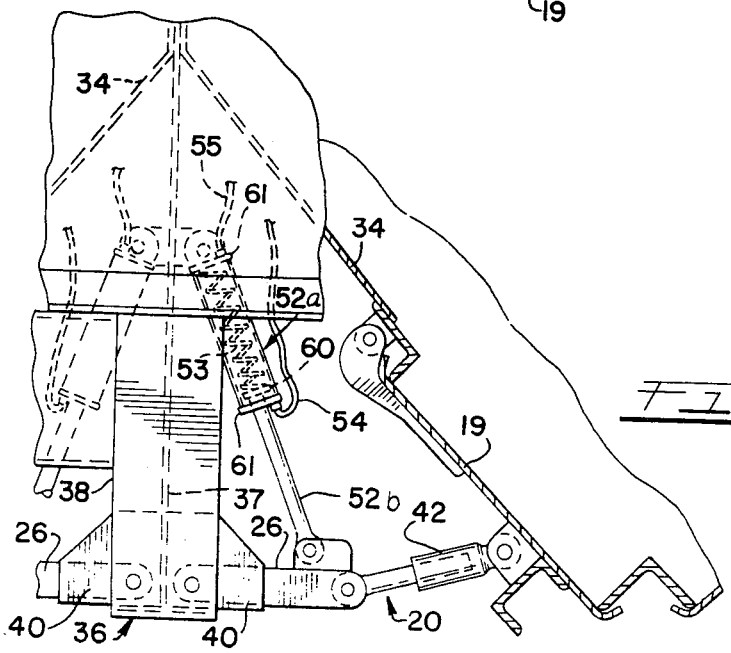
FIG. 8

HOPPER CAR DISCHARGE GATE OPERATING MECHANISM

This is a continuation of application Ser. No. 871,640, filed Jan. 23, 1978 now abandoned.

BACKGROUND OF THE INVENTION (1) Field of the Invention

This invention pertains to discharge gate operating mechanisms for railway hopper cars.

(2) Description of the Prior Art

The prior art operating mechanisms, while showing discharge gates that are actuated by trackside cams, oftentimes involve complicated operating mechanisms such as that shown in the Ried U.S. Pat. No. 3,765,341 (1973). A complicated mechanism with a number of links is objectionable because of the chance for malfunctioning when clogged by debris or by snow, ice or the like. Further, the prior art does not provide adequate safety devices to prevent damage to the mechanism in the event jamming occurs and the gates cannot be opened when the roller is engaged by the trackside cam. The gate operating mechanism disclosed herein provides a safety release feature, ease of adjustment and reliability of operation not heretofore disclosed by the prior art.

SUMMARY OF THE INVENTION

This invention pertains to a hopper car discharge gate operating mechanism which has a toggle or over center linkage that provides a design feature in which the mechanism is automatically locked when the closed position. That is, the linkage members are urged into a state of compression through the force of lading bearing upon associated discharge gates and thus maintain the operating mechanism in an over center, locked position and automatically holding the links in a locked position through the influence of a mechanism biasing member or spring and the weight of lading within the hoppers.

Operation of the gate operating mechanism can occur in a number of ways and it is anticipated that a roller member extending outwardly of the vehicle a short distance is engageable with a track side cam for opening the discharge gates. Because of the operation and design of the mechanism, a single track, having a pair of inclined or slopped surfaces, can be utilized to open a discharge gate regardless of the direction the hopper car is moving.

The roller is attached to a support arm that is pivotally connected to a gate operating link member. The roller support arm is held in a non-pivoting condition by a safety release pin that is designed to allow the arm and associated roller to break the pin and release in the event the gates are frozen closed or the discharge mechanism is otherwise prevented from operating. Thus, the mechanism members on the car and the track side ramp arrangement will not be damaged.

A biasing member in the form of a coil spring or pneumatically operated piston is associated with the discharge mechanism and operates to urge the mechanism and discharge gate back into a closed configuration after lading has been emptied from the hoppers.

A modification of the invention provides a double acting air cylinder in place of the biasing spring. The air cylinder is powered by air pressure in two directions to both open and close the hopper doors by applying door operating forces to the toggle type door operating linkage.

It is an object of the disclosure to provide a door operating mechanism that may be operated by a ramp located at trackside which engages a portion of the door operating mechanism as the hopper car moves past the ramp.

It is another object of this invention to provide a door operating mechanism having a portion extending outwardly of the railway hopper car and which may be engaged by ground mounted jack or other mechanically operated means that move vertically and could operate to open the hopper car doors.

It is yet another object of this invention to provide a toggle type of door operating mechanism with a roller extending outwardly therefrom to engage a track side mounted inclined, cam-type ramp to open the associated hopper car doors. In conjunction with this objective the roller is mounted on a support arm and pivoted at one end and having a break away pin connected thereto which will fracture and allow the roller to release in event the mechanism or the associated door is stuck, frozen closed or otherwise prevented from opening as expected.

It is another object of this disclosure to provide a railway hopper car having discharge doors arranged transversely of the hopper car and having a toggle type over center locking mechanism with a biasing spring for urging the doors closed and maintaining a mechanism in a self-locked position.

It is yet another object of this disclosure to provide a railway hopper car having discharge gates for allowing lading to flow from storage hoppers and having connected therewith a toggle type linkage mechanism with a stop bracket that permits the linkage to move a short distance over center into a self-locking configuration and which mechanism is operatively connected with a double acting air cylinder which may be selectively energized to both open and close the discharge gates.

Further, it is an object of this invention to provide a railway hopper vehicle having transversely disposed discharge gates with an adjustable toggle link attached to each gate and extending therefrom to an actuating member comprising a rectangular shaped link having a first portion pivotally attached to the adjustable link and having a second portion extending outwardly therefrom and providing support for an operating roller which is positioned to contact a track side mounted operating ramp for opening the hopper gates.

These and other objects of the invention will become apparent to those having ordinary skill in the art with reference to the following drawings, description and claims.

BRIEF DESCRIPTION OF THE DRAWINGS

FIG. 1 is a side elevation view of the hopper vehicle showing the operating mechanism disclosed herein;

FIG. 2 is a longitudinal sectional view of the discharge gate operating mechanism;

FIG. 3 is a sectional view taken generally along lines 3—3 of FIG. 2;

FIG. 4 is a sectional view taken along lines 4—4 of FIG. 2;

FIG. 5 is a side elevational view, with portions in sections of the operating mechanism shown in the dooropened position;

FIG. 6 is a side elevational view, with portions removed, of the track side mounted operating ramp;

FIG. 7 is a view taken generally along lines 7—7 of FIG. 6; and

FIG. 8 is a side elevational view, partially in sections, of a modification of the disclosure.

DETAILED DESCRIPTION

Referring now to the drawings and in particular to FIG. 1, there is shown a railway hopper vehicle or hopper car 10 having usual reinforced side wall units 12 and including a longitudinally extending center sill 14. Usual spaced trucks 15 support the car at each end. To form hoppers for transport of lading such as cement, plastic pellets, grain, sand or the like, a number of spaced or individual hoppers are provided and include end slope sheets 16 associated with each end hopper 17. An intermediate hopper 18 is located between the end hoppers. Associated with each of the hoppers is a discharge gate 19 that is attached for pivotal movement between an open position (FIG. 5) and closed position (FIG. 2) relative to its associated discharge openings.

For automatically opening and closing each discharge gate 19 an operating mechanism 20 is provided. The operating mechanism 20 is actuated to open at the associated discharge gate 19 through action of a track-side ramp or cam 22 which is positioned to engage roller 24 of the operating mechanism 20. As the hopper car 10 moves along a track, rollers 24 come in contact with the track side ramp 22 and the roller 24 will be raised to open the associated discharge gates 19.

Operating mechanism 20 includes a number of elements that provide a linkage for opening and closing the doors as roller 24 is moved vertically. Actuating member 26 provides a support for the roller 24 and includes the roller arm 28. The roller arm 28 is pivotally connected to the actuating member 26 at 29. A locking pin 30 holds the roller arm 28 in the operative position to move with the actuating member 26. As shown in FIG. 3, the actuating member 26 is pivotally attached to the car at 32, 33.

Intermediate slope sheets 34 direct lading toward discharge openings for removal from the hopper car 10. These slope sheets are shown more particularly in FIGS. 2, 5 and 8.

Positioned between intermediate slope sheets 34 are mechanism hangar beams 36 which are adapted to support portions of the door operating mechanism 20. As shown in FIGS. 2, 5 and 8 each hangar beam 36 is a reinforced structure having a vertically, transversely extending web 37 reinforced around its periphery by flanges 38. The structure provides a rigid portion of the car to adequately support the operating mechanism 20. As shown in the illustrations, there are no diagonal supports for the hangar beam 36 because longitudinal forces generated by the linkage members are offset by other linkage members. For example, longitudinal forces carried by the actuating member 26 corresponds with equal and oppositely applied horizontal components of the adjacent actuating member 26 which are cancelled out. In the embodiment shown, vertical forces are carried by the hangar beam 36 and thus eliminates the need for space consuming and expensive diagonal supports.

As shown in the drawings, actuating member 26 is limited in its downward movement by stop bracket 40 which has a lower ledge that supports actuating member 26 in its lowest position. When actuating member 26 is in essentially a horizontal position (FIG. 3), a toggle link 42 extends pivotally from pivot pin 44 to the associat discharge gate 19. Toggle link 42 is adjustable in length and is provided with telescoping members or any other construction that may be conveniently adjusted as by screwing the members relative to one another or setting the length with aligned openings through which is fitting a locking pin or the like.

As shown in FIG. 3, actuating member 26 is rectangular and extends in a plane from toggle link 42 outwardly of the vehicle.

Referring now to FIG. 2, there is shown a return spring assembly 46 which may comprise a coil spring mounted within telescoping canisters which guide and protect the spring from contamination and from the elements. As shown in FIG. 4, return spring assembly 46 is pinned at one end to the slope sheets 34 by brackets 48 and pinned at 50 to actuating member 26. Forces generated by the return spring assembly 46 constantly urge the actuating member 26 downwardly. This downward force urges and maintains actuating member 26 in a horizontal position. When in the horizontal position, forces of lading against the door 19 urge toggle link 42 into actuating member 26 in such a manner which tends to rotate actuating member in a clockwise direction as viewed in FIG. 8. Because forces from the lading through line 42 pass below the pivot pins 32, 33 there is an over center or self-locking feature provided to the mechanism. Constant forces from return spring 46 maintain the actuating member 26 in a horizontal position in order to keep the doors closed when there is no lading in the car and there is a chance that the doors would otherwise open during transit.

Another embodiment of the invention is shown in FIG. 8 wherein a pneumatic cylinder 52 takes the place of the previously described return spring assembly 46. To operate the pneumatic cylinder 52 a pair of air lines 54, 55 are provided. Cylinder 52 is a so-called double acting pneumatic cylinder having a fixed cylinder **52*a* and a movable piston 52*b* which moves to both open and close the hopper gates 19. Coil spring 53 extends between stop washers 60, 61 and provides a force which maintains the gate 19 in a closed position in the event there is no air pressure in cylinder 53 urging the gate 19** closed.

As shown in FIG. 6, the door operating mechanism 20 may be operated with a track side ramp 22 having at least one or perhaps two inclined surfaces 56. Separating the inclined surfaces there may be provided a flat, horizontal section 57. In operation, when the rollers 24 engage the inclined surface 56 the roller will more vertically and in turn will rotate the actuating member 26 from the position shown in FIG. 2 to the door open position shown in FIG. 5. Thus, the inclined portion is used for opening the car door and the flat portion is used to hold the door open while lading flows from the hoppers. A second inclined portion 56 may also be provided in order to allow the discharge gates 19 to close slowly and gradually or to open the discharge gates 19 when the hopper car 10 approaches from the opposite direction.

As shown in FIG. 6, the ramp operating mechanism 22 may be movable vertically with the use of pneumatic or hydraulic lifts 58. When not in use, ramp 52 may be lowered to track level or below track level in order that it not interfere with any cars moving on the track and in order that hopper discharge gates are not inadvertently opened at an improper location.

Thus, it has been shown with this disclosure that an operating mechanism is provided that insures a reliable door opening system that may be automatically operated at trackside, or operated pneumatically with a car mounted pneumatic cylinder. A safety feature is provided by the roller arm 28 which includes a fracture type locking pin 30 that will break in the event the hopper doors 19 or any parts of the mechanism are jammed or otherwise inoperative and unable to move properly. After pin 30 breaks, roller arm 28 is free to pivot about its hinge pin 29.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. In a railway hopper car having hoppers for transporting and storing particulate material, and having discharge gates for unloading the particulate material, a gate operating mechanism, the improvement comprising:

pivoted discharge gate means movable from a first, closed position to a second, open position;

a linkage mechanism;

said linkage mechanism having a pivoted actuating member with means extending outwardly of the railway hopper car;

said means extending outwardly of the hopper car including means engageable with trackside means for opening said discharge gate;

said means extending outwardly of the railway vehicle including roller means and support arm means therefor;

said support arm means for the roller means comprising an arm with pivot means connecting with the actuating member;

said support arm means also including a lock for releasably attaching the support arm to said actuating member;

a toggle link means with a first pivot means pivotally connecting with the actuating member and second pivot means pivotally connected with said discharge gate means;

gate return means for moving the hopper gate from the second or open position to the closed position.

2. The railway car of claim 1 wherein the hopper car discharge gate operating mechanism includes:

said toggle link means comprising adjustable means having a first portion attached to said gate and a second portion attached to the actuating member;

means interconnecting said first and second portions for adjusting the length of the toggle link means.

3. The railway car of claim 1 wherein said gate return means includes:

biasing means with means connected to the car and means pivotally attached to the actuating member for urging the discharge gate from the open position to the closed position.

4. The railway car of claim 3 wherein said biasing means comprises:

a coil spring;

canister means with telescoping portions encircling the coil spring.

5. The railway car of claim 1 and:

trackside cam track having means positioned for engagement with the means extending from the hopper car to pivot said actuating member to open said discharge gate.

6. The railway car of claim 5 wherein said trackside cam track includes height adjustment members for varying the vertical position of the means positioned for engagement with the means extending from the hopper car for selective operating of the car mounted gate operating mechanism.

7. The railway car of claim 6 wherein the beam member extending across the railway vehicle includes:

stop means with means for contacting the actuating member to prevent rotation beyond the stop means.

8. The railway car of claim 1, and: mechanism hangar means with means attached to the hopper car and providing a vertically extending web disposed transversely of the vehicle and having reinforcing flanges thereby providing a beam extending across the vehicle.

* * * * *